US011193185B2

(12) United States Patent
Copland et al.

(10) Patent No.: US 11,193,185 B2
(45) **Date of Patent: *Dec. 7, 2021**

(54) PRODUCING TITANIUM ALLOY MATERIALS THROUGH REDUCTION OF TITANIUM TETRACHLORIDE

(71) Applicant: General Electric Company, Schenectady, NY (US)

(72) Inventors: Evan H. Copland, Melbourne (AU); Albert Santo Stella, Voorheesville, NY (US); Eric Allen Ott, Cincinnati, OH (US); Andrew Philip Woodfield, Maineville, OH (US); Leon Hugh Prentice, Melbourne (AU)

(73) Assignee: General Electric Company, Schenectady, NY (US)

( * ) Notice: Subject to any disclaimer, the term of this patent is extended or adjusted under 35 U.S.C. 154(b) by 77 days.

This patent is subject to a terminal disclaimer.

(21) Appl. No.: 16/343,445

(22) PCT Filed: Oct. 20, 2017

(86) PCT No.: PCT/US2017/057600

§ 371 (c)(1),
(2) Date: Apr. 19, 2019

(87) PCT Pub. No.: WO2018/075896

PCT Pub. Date: Apr. 26, 2018

(65) Prior Publication Data

US 2019/0241993 A1 Aug. 8, 2019

Related U.S. Application Data

(60) Provisional application No. 62/411,214, filed on Oct. 21, 2016.

(51) Int. Cl.
*C22B 34/12* (2006.01)
*C22C 1/04* (2006.01)
(Continued)

(52) U.S. Cl.
CPC ..... *C22B 34/1272* (2013.01); *B22F 9/20* (2013.01); *B22F 9/24* (2013.01); *C22B 34/1277* (2013.01);
(Continued)

(58) Field of Classification Search
CPC ..... C22B 34/1272; C22B 34/1277
(Continued)

(56) References Cited

U.S. PATENT DOCUMENTS 2,745,735 A 5/1956 Byrns
2,770,541 A 11/1956 Singleton
(Continued)

FOREIGN PATENT DOCUMENTS

CN 101289754 A 10/2008
CN 101454467 A 6/2009
(Continued)

OTHER PUBLICATIONS

Bharani, D.J. and Acoff, V.L., Autogenous Gas Tungsten Arc Weldability of Cast Alloy Ti—48Al—2Cr—2Nb (atomic percent) vs. Extruded Alloy Ti—46Al—2Cr—2Nb—0.9Mo (Atomic Percent), Metallurical and Materials Transactions, vol. 29A (Mar. 1998) (Year: 1998).*
(Continued)

*Primary Examiner* — Coris Fung
*Assistant Examiner* — Danielle Carda
(74) *Attorney, Agent, or Firm* — Dority & Manning, P.A.

(57) ABSTRACT

Process for producing a titanium alloy material, such as a titanium aluminum alloy, are provided. The process includes reduction of $TiCl_4$, which includes a titanium ion ($Ti^{4+}$),
(Continued)

through intermediate ionic states of an $AlCl_3$-based salt solution that includes $Ti^{3+}$ and an $AlCl_3$-based salt solution that includes $Ti^{2+}$, which may then undergo a disproportionation reaction to form the titanium aluminum alloy.

32 Claims, 4 Drawing Sheets

(51) Int. Cl.
*C22C 14/00* (2006.01)
*B22F 9/20* (2006.01)
*B22F 9/24* (2006.01)

(52) U.S. Cl.
CPC ..... *C22C 1/0458* (2013.01); *C22C 14/00* (2013.01); *B22F 2201/10* (2013.01); *B22F 2301/205* (2013.01)

(58) Field of Classification Search
USPC ..... 75/351
See application file for complete search history.

(56) References Cited

U.S. PATENT DOCUMENTS

| | | | |
|---|---|---|---|
| 2,835,568 | A | 5/1958 | Kingsbury |
| 3,075,837 | A | 1/1963 | Conklin et al. |
| 3,770,656 | A | 11/1973 | Haag et al. |
| 3,977,863 | A | 8/1976 | Glaeser |
| 4,445,931 | A | 5/1984 | Worthington |
| 8,388,727 | B2 | 3/2013 | Klevtsov et al. |
| 8,562,712 | B2 | 10/2013 | Haidar |
| 8,632,724 | B2 | 1/2014 | Haidar |
| 8,790,441 | B2 | 7/2014 | VanVuuren et al. |
| 8,821,612 | B2 | 9/2014 | Haidar et al. |
| 8,834,601 | B2 | 9/2014 | Haidar |
| 8,894,738 | B2 | 11/2014 | Jacobsen et al. |
| 8,911,529 | B2 | 12/2014 | Withers et al. |
| 9,080,224 | B2 | 7/2015 | Haidar |
| 2003/0234176 | A1 | 12/2003 | Haidar |
| 2006/0191372 | A1 | 8/2006 | Haidar |
| 2008/0069720 | A1 | 3/2008 | Renkel et al. |
| 2009/0165597 | A1 | 7/2009 | Haidar et al. |
| 2013/0019717 | A1 | 1/2013 | Haidar |
| 2013/0319177 | A1 | 12/2013 | Haidar |
| 2015/0040726 | A1 | 2/2015 | Jacobsen et al. |
| 2015/0275332 | A1 | 10/2015 | Haidar |

FOREIGN PATENT DOCUMENTS

| | | | |
|---|---|---|---|
| CN | 102065992 | A | 5/2011 |
| CN | 102712966 | A | 10/2012 |
| CN | 103298742 | A | 9/2013 |
| DE | 102004022578 | A1 | 12/2005 |
| SU | 174792 | A1 | 9/1965 |
| SU | 1582683 | A1 | 9/1996 |
| WO | WO00/05017 | A1 | 2/2000 |
| WO | WO02/06554 | A1 | 1/2002 |
| WO | WO02/070759 | A1 | 9/2002 |
| WO | WO2005/002766 | A1 | 1/2005 |
| WO | WO2007/109847 | A1 | 10/2007 |
| WO | WO2011/072338 | A1 | 6/2011 |
| WO | WO2017/219075 | A1 | 12/2017 |
| WO | WO2017/219077 | A1 | 12/2017 |
| WO | WO2018/006133 | A1 | 1/2018 |
| WO | WO2018/075887 | A1 | 4/2018 |
| WO | WO2018/075896 | A1 | 4/2018 |
| WO | WO2018/128665 | A3 | 7/2018 |

OTHER PUBLICATIONS

Co-Pending Australian Patent Application No. PCT/AU2016/900139 filed Jan. 18, 2016.

Co-Pending Australian Patent Application No. PCT/AU2016/900380 filed Feb. 5, 2016.

Co-Pending Australian Patent Application No. PCT/AU2016/900509 filed Feb. 15, 2016.

International Search Report and Opinion issued in connection with Corresponding International Application No. PCT/US2017/057588 filed Oct. 20, 2017.

International Search Report and Opinion issued in connection with Corresponding International Application No. PCT/US17/57600 filed Oct. 20, 2017.

International Search Report and Opinion issued in connection with Corresponding International Application No. PCT/US2017/057607 filed Oct. 20, 2017.

Haidar et al., Direct Production of Alloys based on Titanium Aluminides, Elsevier ScienceDirect, vol. 17, Issue 8, Aug. 2009, pp. 651-656. (Abstract Only) https://doi.org/10.1016/j.intermet.2009.02.005.

Okabe et al., Reaction pathways during metallothermic reduction of TiCl4 by utilizing chemical potential diagrams, Titanium Extraction and Processing, XX, XX, Jan. 1, 1997 (Jan. 1, 1997), pp. 133-151, XP008087398.

International Search Report Corresponding to Application No. PCT/US2017/057600 dated Dec. 15, 2017.

Russian Search Report Corresponding to Application No. 2019111820 dated Jan. 21, 2020.

Combined Chinese Office Action and Search Report Corresponding to Application No. 201780078869 dated Jan. 13, 2021.

* cited by examiner

PRODUCING TITANIUM ALLOY MATERIALS THROUGH REDUCTION OF TITANIUM TETRACHLORIDE

PRIORITY INFORMATION

The present application claims priority to U.S. Provisional Patent Application Ser. No. 62/411,214 filed on Oct. 21, 2016, which is incorporated by reference herein.

FIELD OF THE INVENTION

The present invention relates generally to methods for producing titanium alloy materials through reduction of titanium tetrachloride ($TiCl_4$) in an $AlCl_3$-based reaction media. More particularly, the titanium alloy materials are formed through reducing the $Ti^{4+}$ in the $TiCl_4$ to a lower valence form of titanium (e.g., $Ti^{3+}$ and $Ti^{2+}$), followed by a disproportionation reaction of $Ti^{2+}$. Optionally, other alloying elements may also be formed from a salt to the alloy in a reduction and/or disproportionation process.

BACKGROUND OF THE INVENTION

Titanium alloy materials that include aluminum, such as titanium-aluminum (Ti—Al) based alloys and alloys based on titanium-aluminum (Ti—Al) inter-metallic compounds, are very valuable materials. However, they can be difficult and expensive to prepare, particularly in a powder form, and there are certain alloys inaccessible by traditional melt processes. This expense of preparation limits wide use of these materials, even though they have highly desirable properties for use in aerospace, automotive and other industries.

Reactors and methods for forming titanium-aluminum based alloys and inter-metallic compounds have been disclosed. For example, WO 2007/109847 teaches a stepwise method for the production of titanium-aluminum based alloys and inter-metallic compounds via a two stage reduction process, based on the reduction of titanium tetrachloride with aluminum. WO 2009/129570 discloses a reactor adapted to address one of the problems associated with the reactors and methods disclosed in WO 2007/109847, when such are used under the conditions that would be required to form low-aluminum titanium-aluminum based alloys.

However, the discussion of the chemical processes that actually occur in the processes described by WO 2007/109847 and WO 2009/129570 do not represent a complete understanding of the actual reactions occurring to form the metal alloy from metal halide precursors.

In view of these teachings, a need exists for a better understanding of the chemical processes for producing titanium aluminum alloys through reduction of titanium tetrachloride $TiCl_4$, as well as improved processing techniques for such reactions.

The above references to the background art do not constitute an admission that such art forms a part of the common general knowledge of a person of ordinary skill in the art.

BRIEF DESCRIPTION OF THE INVENTION

Aspects and advantages of the invention will be set forth in part in the following description, or may be obvious from the description, or may be learned through practice of the invention.

A process is generally provided for producing a titanium alloy material, such as a titanium aluminum alloy. In one embodiment, the process includes adding $TiCl_4$ to an input mixture at a first reaction temperature such that at least a portion of the $Ti^{4+}$ in the $TiCl_4$ is reduced to a first intermediate mixture. The input mixture may include aluminum, optionally $AlCl_3$, and, optionally, one or more alloying element chloride. The first intermediate mixture may be an $AlCl_3$-based salt solution that includes $Ti^{3+}$. Then, heating to a second reaction temperature may be performed such that at least a portion of the $Ti^{3+}$ of the first intermediate reaction mixture is reduced to a second intermediate reaction mixture, with the second intermediate reaction mixture being an $AlCl_3$-based salt solution that includes $Ti^{2+}$. In one embodiment, adding $TiCl_4$ to the input mixture at the first reaction temperature and heating to the second reaction temperature are performed sequentially in a reaction process. The second intermediate reaction mixture may be further heated to a third reaction temperature such that the $Ti^{2+}$ forms the titanium alloy material via a disproportionation reaction.

In one embodiment, the process for producing a titanium-containing material may include: mixing Al particles, $AlCl_3$ particles, and, optionally, particles of at least one other alloy chloride to form an input mixture; adding $TiCl_4$ to the input mixture; reducing $Ti^{4+}$ in the $TiCl_4$ in the presence of the input mixture at a first reaction temperature to form a first intermediate mixture comprising $Ti^{3+}$, wherein the first reaction temperature is lower than about 150° C.; and reducing the first intermediate mixture comprising $Ti^{3+}$ in the presence of the input mixture at a second reaction temperature to form a second intermediate mixture comprising $Ti^{2+}$, wherein the second reaction temperature is about 160° C. to about 250° C.

In one embodiment, the process for producing a titanium alloy material may include: adding $TiCl_4$ to an input mixture at a first reaction temperature such that at least a portion of the $Ti^{4+}$ in the $TiCl_4$ is reduced to a first intermediate mixture, with the input mixture including aluminum, optionally $AlCl_3$, and, optionally, one or more alloying element chloride, and wherein the first intermediate mixture comprises an $AlCl_3$-based salt solution that includes $Ti^{3+}$. Then, heating to a second reaction temperature may be performed such that at least a portion of the $Ti^{3+}$ of the first intermediate reaction mixture is reduced to a second intermediate reaction mixture (e.g., an $AlCl_3$-based salt solution that includes $Ti^{2+}$). Adding $TiCl_4$ to the input mixture at the first reaction temperature and heating to the second reaction temperature may be performed sequentially in a reaction process.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
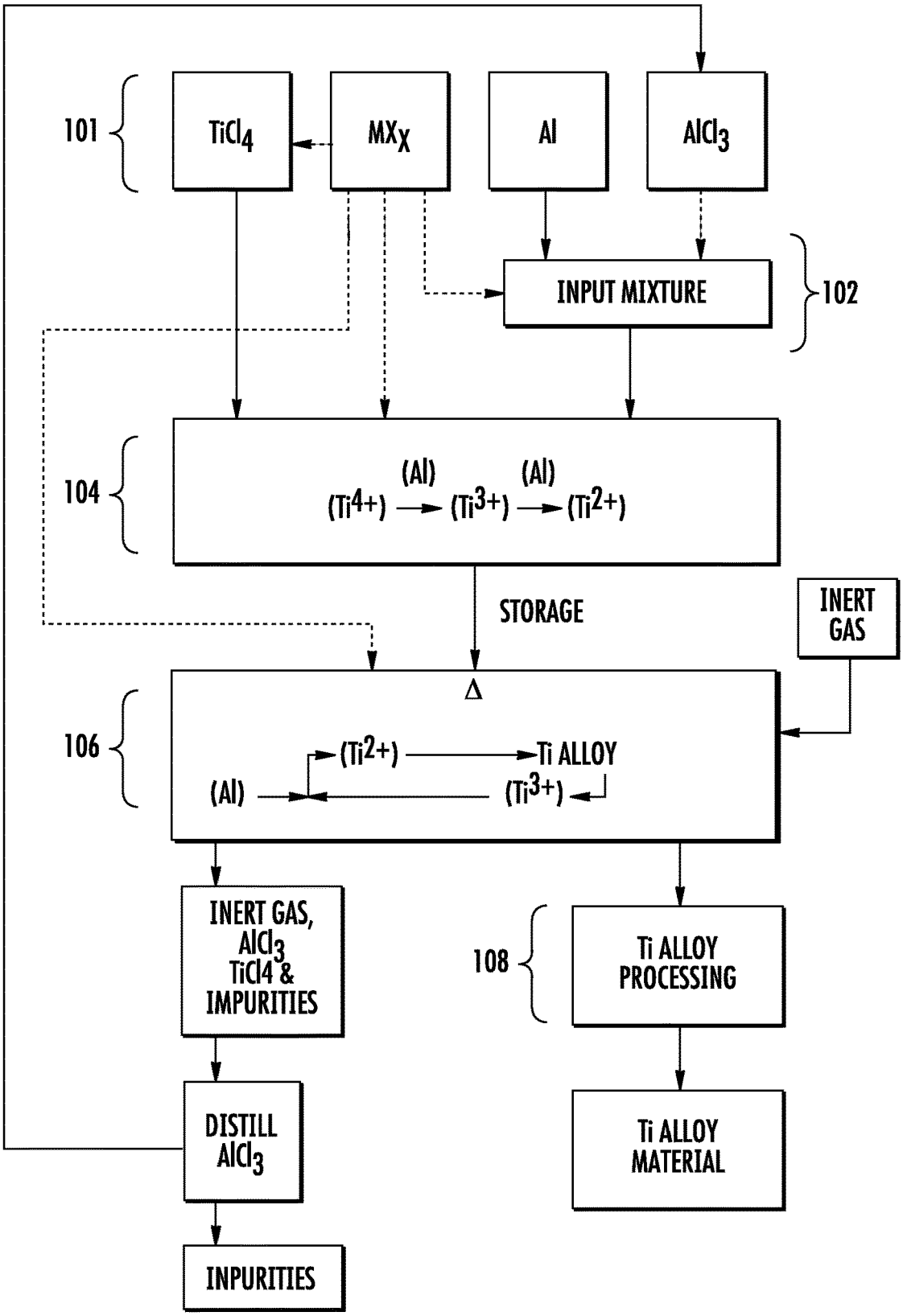
FIG. 1 shows a diagram of an exemplary process according to one embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

As used herein, the term "titanium alloy material", or the like, is to be understood to encompass an alloy based on titanium or an alloy based on a titanium intermetallic compound and optionally other additional alloying elements in addition to Ti and Al. Similarly, the term "titanium-aluminum alloy", or the like, is to be understood to encompass an alloy based on titanium-aluminum or an alloy based on titanium-aluminum intermetallic compounds and optionally other additional alloying elements in addition to Ti and Al.

As used herein, the term "aluminum chlorides" is to be understood to refer to aluminum chloride species or a mixture of such aluminum chloride species, including $AlCl_3$ (solid, liquid, or vapor) or any other Al—Cl compounds or ion species (e.g., AlCl, $AlCl_2$, $(AlCl_4)^-$, $Al_2Cl_6$ and $(Al_2Cl_7)^-$). The use of $AlCl_x$ refers to the term "aluminum chlorides" and is to be understood to refer to such aluminum chloride species or a mixture of such aluminum chloride species, no matter the stoichiometric ratio.

As used herein, the term "titanium chloride" is to be understood to refer to titanium trichloride ($TiCl_3$) and/or titanium dichloride ($TiCl_2$), or other, combinations of titanium and chlorine, but not to $TiCl_4$, which is referred to herein as titanium tetrachloride. In some sections of the specification, the more general term "$TiCl_x$" may be used, which is to be understood to refer to titanium chloride species and forms of titanium tetrachloride ($TiCl_4$), titanium trichloride ($TiCl_3$), titanium dichloride ($TiCl_2$) and/or other combinations of titanium and chlorine in solid, liquid or vapor forms. Since various solution phases and titanium chloride complexes also exist, the specific oxidation state of the Ti ion (e.g., $Ti^{2+}$, $Ti^{3+}$, and $Ti^{4+}$) in a general phase (i.e., salt mixture) is referred to herein rather than any specific chemical compounds.

As used herein, the term "alloying element halides" refers to an alloying element ion coupled with a halide (e.g., a chloride, a fluoride, a bromide, an iodide, or an astatide). The alloying element can be any element that would be included within the final titanium alloy material, such as metals and other elements. The "alloying element halide" can be represented by $MX_x$, where M is the alloying element ion and X is a halide (i.e., a halogen ion), no matter the stoichiometric ratio (represented by x). For example, an alloying element chloride can be represented by $MCl_x$.

Processes are generally provided for producing titanium alloy materials (e.g., titanium aluminum alloys) through reduction of $TiCl_4$, which includes a titanium 4+ ion ($Ti^{4+}$). More particularly, the titanium alloy materials are formed through reducing the $Ti^{4+}$ in the $TiCl_4$ to a lower valence form of titanium (e.g., $Ti^{3+}$ and $Ti^{2+}$), followed by a disproportionation reaction of $Ti^{2+}$ to form the titanium alloy material. It is noted that the valence form of titanium (e.g., $Ti^{4+}$, $Ti^{3+}$, and/or $Ti^{2+}$) may be present in the reaction and/or intermediate materials as a complex with other species in the mixture (e.g., chlorine, other elements, and/or other species such as chloro-aluminates, metal halo aluminates, etc.), and may not necessarily be present in pure form of $TiCl_4$, $TiCl_3$, and $TiCl_2$, respectively. For example, metal halide aluminates can be formed by $MX_x$ complexed with $AlCl_3$ in these intermediates, such as described below. Generally, $AlCl_3$ provides the reaction media that the reactive species (e.g., $Ti^{4+}$, $Ti^{3+}$, $Ti^{2+}$, Al, Al, $Al^{2+}$, $Al^{3+}$, also alloying element ions) for all reactions. Without wishing to be bound by any particular theory, it is believed that the existence of salt solutions in the stage 1 reactions allows for the $Ti^{4+}$ reduction to $Ti^{3+}$ and for the $Ti^{3+}$ reduction to $Ti^{2+}$ to occur in the condensed state (e.g., solid and liquid), such as at temperatures of about 700° C. or less (e.g., about 300° C. or less).

FIG. 1 shows a general flow diagram of one exemplary process 100 that reduces $TiCl_4$ to a titanium alloy material. The process 100 is generally shown in sequential stages: reaction precursors at 101 (including forming an input mixture at 102), a stage 1 reaction at 104, a stage 2 reaction at 106, and post processing at 108.

I. Reaction Precursors

The reaction precursors for the stage 1 reaction 104 in the process 100 of FIG. 1 include, at a minimum, $TiCl_4$ and an input mixture that includes aluminum (Al), either alone or with additional chloride components. In one embodiment, the reaction precursors include an input mixture as a solid material at ambient conditions (e.g., about 25° C. and 1 atm), and $TiCl_4$ in liquid form. Additional materials (e.g., $AlCl_3$ and/or other alloying element halides) may be included in the reaction precursors at various stages of process 100, such as included within the input mixture, within the $TiCl_4$, and/or as a separate input into the stage 1 and/or stage 2 reactions. That is, one or more alloying element chlorides can optionally be inputted into the stage 1 reaction materials (e.g., into the input mixture if a solid, into the $TiCl_4$ if a liquid or a soluble solid material, and/or directly into the stage 1 reaction vessel, independently), dissolved into another component of the input materials, and/or may optionally be inputted into the Stage 2 reaction materials. In certain embodiments, particularly where the alloying element halide is added to liquid $TiCl_4$ (e.g., soluble within), the liquid $TiCl_4$ may be filtering so as to remove any particulate within the liquid stream. Such a filter may, in particular embodiments, refine the liquid stream by removing oxygen species from the liquid, since the solubility of oxygen and oxygenated species is extremely low. As such, filtering of the $TiCl_4$ liquid (with or without any alloying element halide dissolved therein) may tailor the chemistry of the liquid and remove oxygen species therefrom.

For example, the reaction precursors can include some or all alloy elements to achieve a desired chemistry in the titanium alloy material. In one embodiment, the alloying element halide ($MX_x$) may an alloying element chloride ($MCl_x$). Particularly suitable alloying elements (M) include, but are not limited to, vanadium, chromium, niobium, iron, yttrium, boron, manganese, molybdenum, tin, zirconium, silicon, carbon, nickel, copper, tungsten, beryllium, zinc, germanium, lithium, magnesium, scandium, lead, gallium, erbium, cerium, tantalum, osmium, rhenium, antimony, uranium, iridium, and combinations thereof.

As shown in FIG. 1 at 102, the input mixture is formed from aluminum (Al), optionally an aluminum chloride (e.g., $AlCl_3$), and optionally one or more alloying element chloride. Without wishing to be bound by any particular theory, it is presently believed that $AlCl_3$ is useful as a component in the input mixture, but is not necessarily required if there is an alloying element chloride that is soluble or miscible in the $TiCl_4$ at the stage 1 reaction conditions to form $AlCl_x$ in situ from the alloying element chloride and aluminum. In one embodiment, $AlCl_3$ is included as a material in the input mixture. In this embodiment, the $TiCl_4$ dissolves into the condensed $AlCl_3$-based salt present at the start of the stage 1 reaction, and the reaction products that forms during the stage 1 reaction. In one embodiment, the stage 1 reaction process involves adding $TiCl_4$ slowly, such that excess $AlCl_3$ or $TiCl_3(AlCl_3)_x$ reaction product is always present to ensure $TiCl_4$ adsorption and dissolution into $AlCl_3$ and $TiCl_3(AlCl_3)_x$.

However, in another embodiment, the input mixture may be substantially free from $AlCl_3$. As used herein, the term "substantially free" means no more than an insignificant trace amount present and encompasses "completely free" (e.g., "substantially free" may be 0 atomic % up to 0.2 atomic %). If $AlCl_3$ is not present in the input mixture, then Al and other metal chlorides are present and utilized to form $AlCl_3$ such that the stage 1 reaction can proceed.

If in a solid state at ambient conditions, one or more alloying element chlorides ($MCl_x$) can optionally be included into the input mixture to form the input mixture. Particularly suitable alloying element chlorides in a solid state to be included with the aluminum and optional $AlCl_3$ include, but are not limited to, $VCl_3$, $CrCl_2$, $CrCl_3$, $NbCl_5$, $FeCl_2$, $FeCl_3$, $YCl_3$, $BCl_3$, $MnCl_2$, $MoCl_3$, $MoCl_5$, $SnCl_2$, $ZrCl_4$, $NiCl_2$, CuCl, $CuCl_2$, $WCl_4$, $WCl_6$, $BeCl_2$, $ZnCl_2$, LiCl, $MgCl_2$, $ScCl_3$, $PbCl_2$, $Ga_2Cl_4$, $GaCl_3$, $ErCl_3$, $CeCl_3$, and mixtures thereof. One or more of these alloy element chlorides can also be included at other stages in the process including, but not limited to, titanium tetrachloride and/or after Stage 1.

In one embodiment, the input mixture is in the form of a plurality of particles (i.e., in powder form). For example, the input mixture is formed by milling a mixture of the aluminum (Al), optionally an aluminum chloride (e.g., $AlCl_3$), and optionally one or more alloying element halides (e.g., alloying element chlorides). The material of the input mixture can be combined as solid materials and milled together to form the plurality of particles having a mixed composition. In one embodiment, a mixture of aluminum particles, optionally aluminum chloride particles, and optionally particles of one or more alloying element chlorides is mixed and resized (e.g., milled) together to form the plurality of particles of the input mixture. For example, the aluminum particles can be aluminum particles that have a pure aluminum core with an aluminum oxide layer formed on the surface of the particles. Alternatively, the aluminum particles can include a core of aluminum and at least one other alloying element or a master alloy of aluminum and an alloying element. The aluminum particles may have any suitable morphology, including a flake like shape, substantially spherical shape, etc.

Since the aluminum particles generally form a layer of aluminum oxide on the surface of the particles, the milling process is performed in an atmosphere that is substantially free of oxygen to inhibit the formation of any additional aluminum oxides within the input mixture. For example, the milling process can be performed in an inert atmosphere, such as an argon atmosphere, having a pressure of about 700 torr to about 3800 torr. Without wishing to be bound by any particular theory, it is believed that a reaction between $AlCl_3$ and surface $Al_2O_3$ during milling of Al(s) such that $AlCl_3$ converts $Al_2O_3$ to AlOCl (e.g., via $Al_2O_3+AlCl_3 \rightarrow 3AlOCl$). The $Al_2O_3$ surface layer protects the underlying Al(s), and then converting this $Al_2O_3$ surface layer to AlOCl during milling allows Al to dissolve and diffuse into the salt, as $Al^+$ of $Al^{+2}$. Without wishing to be bound by any particular theory, it is believed that having a partial pressure of oxygen below that required to stabilize $Al_2O_3$ (i.e., in an inert atmosphere) allows for these reactions to convert $Al_2O_3$, which is otherwise very stable in oxygen. As such, the resulting particles are an "activated" Al powder.

Additionally, reducing the size of the particles allows the surface area of the particles to increase to expand the availability of aluminum surface area in the subsequent reduction reactions. The plurality of particles may have any suitable morphology, including a flake like shape, substantially spherical shape, etc. In particular embodiments, the plurality of particles of the input mixture have a minimum particle dimension on average of about 0.5 μm to about 25 μm (e.g., about 1 μm to about 20 μm), which is calculated by averaging the minimum dimension of the particles. For example, in one embodiment, the flake may define a planar particle having dimensions in an x-y plane, and a thickness in a z-dimension with the minimum dimension on average of about 0.5 μm to about 25 μm (e.g., about 1 μm to about 20 μm), while the x- and y-dimensions having larger average sizes. In one embodiment, milling is performed at a milling temperature of about 40° C. or less to inhibit Al particle agglomeration.

Milling can be achieved using a high intensity process or a low intensity process to produce the plurality of particles of the input mixture, such as using a ball milling processes, grinding processes, or other size reduction methods. In alternative embodiments, the size reduction apparatus can be integrated within the stage 1 reaction apparatus.

II. Stage 1 Reactions (Reduction of $Ti^{4+}$ to $Ti^{3+}$ and $Ti^{3+}$ to $Ti^{2+}$)

As stated, the reaction precursors include, at a minimum, $TiCl_4$ in liquid or vapor form and an input mixture in powder form that includes aluminum (Al), and may include additional materials (e.g., $AlCl_3$ and/or other alloying element chlorides). The $TiCl_4$ may be a pure liquid of $TiCl_4$ or liquid mixed with other alloy chlorides. Mixtures of $TiCl_4$ and another alloy chloride(s) may be heated, in certain embodiments, to ensure that the resulting solution is not saturated, which could result in components precipitating out of the solution. An example of mixed liquid precursors includes a mixture of $TiCl_4$ and $VCl_4$ to form a vanadium containing titanium alloy. Various metal chlorides (i.e., $AlCl_3$, $VCl_4$, $VCl_3$, $MCl_x$, etc) may be dissolved into $TiCl_4$(l), which can be represented by $(TiCl_4)_x(AlCl_3)_y(MCl_x)_z$ where M is any suitable metal, as discussed herein, and x, y, and z are the mole fraction of the particular components of the salt solution. Such a salt solution can be generally defined in short hand as [Ti4+:salt], with the brackets [ ] represent the material as a solution phase having Ti4+ as the major species of solvent and "salt" represents all of the minor species or alloying elements.

These reaction precursors are added together for reduction of the $Ti^{4+}$ to $Ti^{3+}$ and for reduction of the $Ti^{3+}$ to $Ti^{2+}$ at the stage 1 reaction 104. At the stage 1 reactions at 104 in the process 100, the $Ti^{4+}$ is reduced to $Ti^{3+}$ by an alumino-thermic process at a first reaction temperature, and then the $Ti^{3+}$ is further reduced to $Ti^{2+}$ by an alumino-thermic process at a second reaction temperature that is greater than the first reaction temperature. However, it is noted that the different temperatures for the reduction of the $Ti^{4+}$ to $Ti^{3+}$ and for reduction of the $Ti^{3+}$ to $Ti^{2+}$ are due to kinetics, not thermodynamics, as discussed in greater detail below. In one embodiment, these reactions can be performed in sequential reactions at different temperatures in a single step reaction or as separate steps as a two-step process (e.g., in stages as the temperature is increased). For the stage 1 reaction, the reduction of the $Ti^{4+}$ to $Ti^{3+}$ and the reduction of the $Ti^{3+}$ to $Ti^{2+}$ can be performed in a reaction chamber as a single reactor, as a multi-step reaction (e.g., a two-step reaction process), or as sequential stages in sequential zones within the reaction chamber. Alternatively, the reaction can be performed in a two reactor system, where the $Ti^{4+}$ is reduced to $Ti^{3+}$ in one reactor and then transferred to a second reactor where the $Ti^{3+}$ is further reduced to $Ti^{2+}$ at a temperature higher than the first reactor.

For example, the reaction precursors are at a first reaction temperature that is about 180° C. or less (e.g., about 100° C. to about 165° C., such as about 140° C. to about 160° C.) in a first reaction zone. In one embodiment, the input mixture is heated to the first reaction temperature prior to adding the $TiCl_4$ to the input mixture. Alternatively or additionally, the $TiCl_4$ can be added to the input mixture simultaneously with heating the input mixture to the first reaction temperature.

Without wishing to be bound by any particular theory, it is believed that the aluminum (e.g., in a form of metallic aluminum or a salt of aluminum such as $AlCl_3$ and/or $AlCl_x$) present the input mixture reduces the $Ti^{4+}$ in the $TiCl_4$ to $Ti^{3+}$ by an alumino-thermic process at the first reaction temperature, where $AlCl_3$ serves as the reaction media in the form of a $AlCl_3$ salt solution. Additionally, it is believed that $Ti^{4+}$ and Al dissolve in $AlCl_3$ and in $TiCl_3(AlCl_3)_x$ formed from the input mixture reaction products, such that the $Ti^{4+}$ and Al can react. It is also believed that Al dissolves in the salt as $Al^+$ or $Al^{2+}$, and that these Al species diffuse to the $Ti^{4+}$ and react to form new $TiCl_3(AlCl_3)_x$ reaction product. Finally, it is believed that Al(s) dissolves into the salt solution through an $AlCl_3$ or AlOCl surface layer on the Al(s). For example, without wishing to be bound by any particular theory, it is believed that the $Ti^{4+}$ in the $TiCl_4$ is reduced to $Ti^{3+}$ in the form of $TiCl_3$ complexed with metal chloride(s), such as $TiCl_3(AlCl_3)_x$ with x being greater than 0, such as greater than 0 to 10 (e.g., x being 1 to 5), which is either a continuous solid solution between $TiCl_3$ and $AlCl_3$ or two solutions $TiCl_3$-rich $TiCl_3(AlCl_3)_x$ and $AlCl_3$-rich $AlCl_3$ $(TiCl_3)_x$ where both solutions have the same crystal structure. Thus, it is believed that substantially all of the $Ti^{3+}$ species formed is in the form of such a metal chloride complex, instead of pure $TiCl_3$.

As such, the resulting reaction product is an $AlCl_3$-based salt solution that includes the $Ti^{3+}$ species. Similar to the [$Ti^{4+}$:salt] discussion above, various metal chlorides (i.e., $AlCl_3$, $VCl_4$, $VCl_3$, $MCl_x$, etc.) dissolve in $TiCl_3$ (solid or liquid), which may be represented by $(TiCl_3)_x(AlCl_3)_y(MCl_x)_z$ where M is any suitable metal and x, y, and z represent the mole fraction of the salt solution. $TiCl_3(AlCl_3)_x$ is a sub-set of the larger solution phase, even though all of the alloying element chlorides, $MCl_x$, dissolve into this solution phase. Additionally, $Ti^{4+}$ also dissolves into this solution phases, which can be described as the Cl-rich side of the phase field. As such, $TiCl_4$ is added into the reaction mixture, at some point there may be more $TiCl_4/TiCl_3$ than $AlCl_3$, making the salt $TiCl_3$-rich. Such a salt solution can be generally defined in short hand as [$Ti^{3+}$:salt], with the brackets [ ] represent the material as a solution phase having $Ti^{3+}$ as the major species of solvent and "salt" represents all of the minor species or alloying elements.

This reaction can be performed as $TiCl_4$ is added in a controlled manner to the input mixture at the second reaction temperature. For example, the $TiCl_4$ can be added continuously or in a semi batch manner. In one embodiment, excess Al is included in the reaction to ensure substantially complete reduction of $Ti^{4+}$ to $Ti^{3+}$ and for subsequent reductions. As such, $TiCl_4$ may be added to obtain a desired Ti/Al ratio to produce a desired salt composition.

In one embodiment, the reduction of $TiCl_4$ is performed by heating to a temperature that is above the boiling point of $TiCl_4$ (e.g., about 136° C.) but below the temperature where $Ti^{3+}$ is further reduced (e.g., over about 160° C.), such as a reaction temperature of about 140° C. to about 180° C. (e.g., about 140° C. to about 160° C.). However, it is noted that Al is capable of reducing $Ti^{4+}$ to $Ti^{3+}$ and $Ti^{3+}$ to $Ti^{2+}$ at all temperatures, including below 20° C. The temperatures identified above are due to kinetic limitations and/or solid state transport in the reaction products. Also, without wishing to be bound by any particular theory, it is believed that the $Ti^{3+}$ to $Ti^{2+}$ reduction cannot occur while $Ti^{4+}$ exists in the stage 1 reaction products due to the Gibbs phase rule and phase exquilibria of the Ti—Al—Cl—O system. That is, Al oxidation can drive both reduction steps at the same temperature, but the sequential aspect of these reactions is due to the present belief that $Ti^{4+}$ and $Ti^{2+}$ cannot exist at the same time in an isolated system. Thus, the reactions are sequentially performed such that substantially all of the $Ti^{4+}$ is reduced to $Ti^{3+}$ prior to the formation of $Ti^{2+}$ in the system. Thus, the reduction process is performed by the presently disclosed methods in a sequential nature.

After the production of the $Ti^{3+}$ from $Ti^{4+}$, further heating to higher temperatures increases kinetics to allow alumino-thermic reduction of $Ti^{3+}$ to $Ti^{2+}$. For example, the reduction of $Ti^{3+}$ to $Ti^{2+}$ can be performed at second reaction temperature of about 160° C. or higher (e.g., about 160° C. to about 500° C., or about 180° C. to about 300° C.).

During these reactions, the input mixture can substantially remain as a condensed phase (e.g., solid or liquid) at the first reaction conditions in the first zone (e.g., the first reaction temperature and the first reaction pressure) and the second reaction conditions in the second zone (e.g., the second reaction temperature and the second reaction pressure). In particular embodiments, the stage 1 reaction is performed in a plow reactor, a ribbon blender, or another liquid/solid/ vapor reactor. For example, the reduction reactions can be performed in an apparatus to reflux during the reaction phase and/or to distill after the reaction phase any unreacted $TiCl_4$ vapor and/or metal chloride or subchloride vapor for continued reduction and reaction.

The stage 1 reactions can be performed in an inert atmosphere (e.g., comprising argon). As such, the uptake of oxygen ($O_2$), water vapor ($H_2O$), nitrogen ($N_2$), carbon oxides (e.g., CO, $CO_2$, etc.) and/or hydrocarbons (e.g., $CH_4$, etc.) by aluminum and/or other compounds can be avoided during the reduction reaction. In particular embodiments, the inert atmosphere has a pressure of 1 atmosphere (e.g., about 760 torr) and about 5 atmospheres (e.g., about 3800 torr), such as about 760 torr to about 1500 torr. Although pressures less than about 760 torr could be utilized in certain embodiments, it is not desirable in most embodiments due to possible oxygen, water, carbon oxide and/or nitrogen ingress at such lower pressures. For example, the inert atmosphere has a pressure of 0.92 atmosphere (e.g., about 700 torr) and about 5 atmospheres (e.g., about 3800 torr), such as about 700 torr to about 1500 torr.

Following the stage 1 reactions reducing $Ti^{4+}$ to $Ti^{2+}$, the reaction products can be dried at drying conditions to remove substantially all of any remaining unreacted $TiCl_4$ to form an intermediate mixture. For example, the intermediate mixture can be formed by drying by heating and/or vacuum conditions. In one embodiment, any entrained $TiCl_4$ is removed from the reaction products by heating to a temperature that is above the boiling point of $TiCl_4$ (e.g., about 136° C.) but below the temperature where disproportion of $Ti^{2+}$ occurs, such as a drying temperature of about 150° C. to about 175° C. (e.g., about 160° C. to about 170° C.).

After forming the intermediate mixture containing the $Ti^{2+}$ complexes, the intermediate mixture can be stored, such as in an inert atmosphere prior to further reaction. In one embodiment, the intermediate mixture containing the $Ti^{2+}$ complexes can be cooled to a temperature below about 100° C., such below about 50° C., or below about 25° C., for storage.

Figure 2:
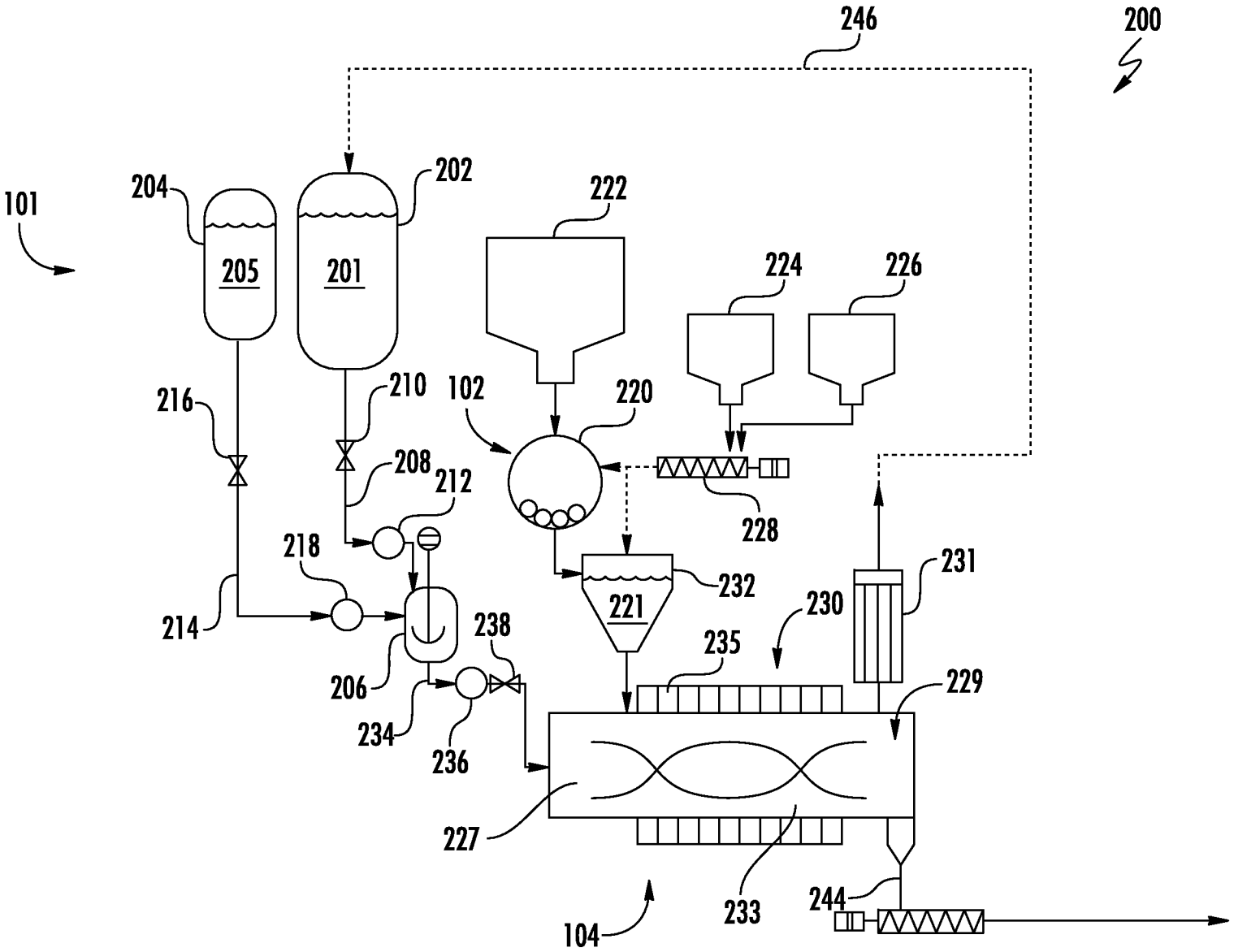
FIG. 2 shows a schematic of one exemplary embodiment of the stage 1 reactions of the exemplary process of FIG. 1.

Referring to FIG. 2, a process schematic 200 of one exemplary embodiment of the reaction precursors at 101 (including forming an input mixture at 102) and the stage 1 reactions at 104 of the exemplary process 100 of FIG. 1. In the embodiment shown, a first liquid storage tank 202 and an optional second liquid storage tank 204 are in liquid communication with a liquid mixing apparatus 206 so as to supply liquid reaction precursors thereto via supply line 208. Generally, the first liquid storage tank 202 includes liquid 201 of $TiCl_4$, as a pure liquid of $TiCl_4$ or liquid mixed with other alloying element chlorides. Valve 210 and pump 212 control flow of liquid 201 from the liquid storage tank 202 into the liquid mixing apparatus 206. Similarly, the second liquid storage tank 204 is in liquid communication with the liquid mixing apparatus 206 so as to supply liquid reaction precursors thereto via supply line 214. The second liquid storage tank 204 includes, in one embodiment, a liquid 205 of at least one alloying element chloride. Valve 216 and pump 218 control flow of liquid 205 from the liquid storage tank 204 into the liquid mixing apparatus 206.

Also as shown in FIG. 2, solid reaction precursors are supplied to the ball milling apparatus 220 from an Al storage apparatus 222, an optional aluminum chloride (e.g., $AlCl_3$) storage apparatus 224, and optionally one or more alloying element chloride storage apparatus 226. Although shown as a ball milling apparatus 220, any suitable size reduction apparatus (e.g., a milling apparatus) can be utilized in accordance with this process. As shown, the aluminum chloride storage apparatus 224 and the one or more alloying element chloride storage apparatus 226 are supplied via an optional mixing apparatus 228 to the milling apparatus 220. From the milling apparatus 220, an input mixture 221 is provided to the stage 1 reaction apparatus 230 via a hopper 232. Additionally, the mixed liquid from the liquid mixer 206 is added to the stage 1 reaction apparatus 230 in a controlled manner via supply tube 234 with the flow of the mixed liquid controlled by the pump 236 and valve 238. Optionally, the aluminum chloride storage apparatus 224 and the one or more alloying element chloride storage apparatus 226 can be supplied via an optional mixing apparatus 228 directly to the hopper 232.

Within the stage 1 reaction apparatus 230, the $Ti^{4+}$ is reduced to $Ti^{3+}$ at the conditions described above at a first temperature, and the $Ti^{3+}$ is reduced to $Ti^{2+}$ at the conditions described above at a second temperature. The exemplary stage 1 reaction apparatus 230 shown is a single stage reactor that includes a heating apparatus 235 surrounding a reaction chamber 233. In one embodiment, the temperature within the reaction chamber 233 can be adjusted to control the progress of the reactions thereon. For example, the temperature can be held at the first reaction temperature (e.g., about 160° C. or less, such as about 100° C. to about 140° C.) such that $Ti^{4+}$ is reduced to $Ti^{3+}$, then dried at about 150° C. to about 175° C. (e.g., about 160° C. to about 170° C.) to remove any residual $TiCl_4$, and then heated to the second reaction temperature (e.g., about 180° C. to about 900° C., such as about 200° C. to about 300° C.) such that $Ti^{3+}$ is reduced to $Ti^{2+}$.

Without wishing to be bound by any particular theory, it is believed that $AlCl_3$ is chemically bound in $TiCl_3(AlCl_3)_x$, $TiAlCl_5$, and $\{Ti(AlCl_4)_2\}_n$ in this process. Due to its significant chemical activity (e.g., <1), $AlCl_3$ does not evaporate as would be expected for pure $AlCl_3$, and there is no significant $AlCl_3$ evaporation until reaction temperatures reach or exceed about 600° C. Thus, $AlCl_3$ provides the reactor medium to allow the reaction to take place, and $AlCl_3$ provides the chemical environment that stabilizes the $Ti^{2+}$ ion and allows conversion of $Ti^{3+}$ to $Ti^{2+}$ at reaction temperatures less than about 250° C. (e.g., about 180° C. to about 250° C.).

Without wishing to be bound by any particular theory, it is generally believed that there are three forms of $TiCl_2$ possible: (1) substantially pure $TiCl_2$ that only dissolves a small amount of anything, (2) $TiAlCl_5$(s) that also does not dissolve much of anything else and is probably only stable up to about 200° C., and (3) $\{Ti(AlCl_4)_2\}$n that is likely an inorganic polymeric material existing as a liquid or gas, glassy material and fine powder (long chain molecules). That is, $\{Ti(AlCl_4)_2\}_n$ has a large composition range (e.g., n can be 2 to about 500, such as 2 to about 100, such as 2 to about 50, such as 2 to about 10) and dissolves all the alloy element chlorides. In one particular embodiment, the gaseous $\{Ti(AlCl_4)_2\}_n$ helps remove unreacted salt from the Ti-alloy particles (e.g., at a low temperature in a later stage of the reaction). As a result, the reaction product comprising $Ti^{2+}$ is a phase based on the complex between $TiCl_2$ and $AlCl_3$ (e.g., $Ti(AlCl_4)_2$, etc.). Such a complex can be a salt solution defined in short hand as [$Ti^{2+}$:salt], with the brackets [ ] represent the material as a solution phase having $AlCl_3$ as the major species of solvent, $Ti^{2+}$ and "salt" represents all of the minor species or alloying elements.

In another embodiment, the heating apparatus 235 is a zone heating apparatus that allows for a variable, increasing temperature within the reaction chamber 233 as the solid reaction materials flows through reaction chamber 233. For example, the zone heating apparatus 235 can have a first reaction temperature towards one input end of the reaction chamber 233 (e.g., a first zone 227) and a second reaction temperature at the output end of the reaction chamber 233 (e.g., a second zone 229). The second zone 229 can also dry the reaction product at the end of the stage 1 reaction apparatus 230 to remove substantially all of any remaining $TiCl_4$ via condenser 231 to form an intermediate mixture (including $Ti^{2+}$, such as in the form of $TiCl_2$ complexed with metal chloride(s)), or a mixture thereof) supplied to product line 244 for disproportionation reaction to form titanium alloy materials. As shown, any remaining $TiCl_4$ can be evaporated and optionally recycled (e.g., via a distillation process, not shown) in recycle loop line 246.

The intermediate mixture (including $Ti^{2+}$, such as in the form of $TiCl_2$ complexed with metal chloride(s)) can be stored after drying nut before further reduction processes. In one embodiment, the intermediate mixture is stored in an inert atmosphere to inhibit and prevent the formation of any aluminum oxides, other oxide complexes, or oxy-chloride complexes within the intermediate mixture.

III. Stage 2 Reaction ($Ti^{2+}$ to Ti Alloy)

After the $Ti^{3+}$ of the $TiCl_3$ complexed with metal chloride(s) (e.g., in the form of $TiCl_3$—$(AlCl_3)_x$ and/or $TiAlCl_6$ (g) is reduced to $Ti^{2+}$ (e.g., in the form of $TiCl_2$ complexed with Al and/or metals), the $Ti^{2+}$ can be converted to a Ti alloy (e.g., a Ti—Al alloy) via a disproportionation reaction. In one embodiment, $TiAlCl_6$ (g) may be present to help remove $Ti^{3+}$ by-products from the Ti-alloy formation and/or recycling $Ti^{3+}$ within the reaction chamber. For example, the $Ti^{2+}$ can be converted to Ti alloy via an endothermic disproportionation reaction at a third reaction temperature of about 250° C. or higher (e.g., about 250° C. to about 1000° C., such as about 250° C. to about 650° C.), such as about 300° C. or higher (e.g., about 300° C. to about 1000° C., such as about 500° C. to about 1000° C.). Although the second reaction temperature may extend to about 1000° C. in certain embodiments, the second reaction temperature has an upper temperature limit of about 900° C. in other embodiments. For example, the $Ti^{2+}$ can be reduced to Ti alloy via a disproportionation reaction at a third reaction temperature of about 300° C. up to about 900° C. (e.g., about 300° C. to about 900° C., such as about 500° C. to about 900° C.). Without wishing to be bound by any particular theory, it is believed that keeping the second reaction temperature below about 900° C. ensures that any oxygen contaminants present in the reaction chamber remain stable volatile species that can be driven off so as to limit oxygen in the resulting Ti alloy product. On the other hand, at reaction temperatures above 900° C., the oxygen contaminants are no longer in the form of volatile species making it more difficult to reduce residual oxygen. Any other volatile species, such as oxychlorides, chlorides, and/or oxides containing carbon, can be removed by thermal distillation.

Generally, this reaction of Ti alloy formation can be separated into an alloy formation stage via disproportionation reaction (e.g., at a disproportionation reaction temperature about 250° C. to about 650° C.) and a distillation stage (e.g., at a distillation temperature of about 650° C. to about 1000° C.).

For instance, without wishing to be bound by any particular theory, it is believed that the reaction may form $Ti^{2+}$ in a $TiCl_2$ complexed with metal chloride(s), to form salt solutions based on titanium aluminum chloride complexes, such as $TiAlCl_5$, $Ti(AlCl_4)_2$), or a mixture thereof, with optionally additionally alloying elements or element halides, or element chloro-aluminates.

For example, the Ti alloy formation can be divided into two processes: nucleation and particle growth (which may also be referred to as particle coarsening). During nucleation, the first Ti alloy forms from the [$Ti^{2+}$:SALT] at lower temperatures (e.g., about 250° C. to about 400° C.). The local composition of the salt (component activities), surface energy, and kinetics of disproportionation determine the resulting Ti alloy composition. Then, the particle growth occurs where the Ti alloy continues to grow from the [$Ti^{2+}$:SALT] at higher temperatures (e.g., about 400° C. to about 700° C.) in the condensed state and at temperatures of greater than 700° C. (e.g., about 700° C. to about 1000° C.) in as a gas solid reaction. These higher temperature reactions (e.g., greater than about 700° C.) can also be described as a distillation process where Cl is removed from the Ti alloy product, which is occurring simultaneously with the Ti alloy particle grown. Both of these processes are based on a disproportionation reaction, but could produce Ti alloys of different compositions. It is also noted that there is a disproportionation reaction for both Ti and Al in the reaction process: $Ti^{2+}=\frac{1}{3}[Ti]+\frac{2}{3}Ti^{3+}$ and $Al^{+}=\frac{2}{3}[Al]+\frac{1}{3}Al^{3+}$. The equipment design for this process may be configured for independent control of the residence time at each temperature (e.g., thermal zone), which may help control the process.

In one embodiment, the intermediate mixture having the $Ti^{2+}$ is maintained at the third reaction temperature until substantially all of the $Ti^{2+}$ is reacted to the titanium alloy material. In the reaction, any $Ti^{3+}$ formed during the disproportionation reaction can be internally recycled to be reduced to $Ti^{2+}$ by thermos alumic reduction and further reacted in a disproportionation reaction. Additionally, $Ti^{4+}$ (e.g., in the form of $TiCl_4$) may be formed during one of the Ti disproportionation reactions, which can be evacuated out of the reaction system as a small amount of lost gas by-product (e.g. carried out via an inert gas counter flow).

The stage 2 reaction (e.g., $Ti^{2+}$ to Ti alloy) can be performed in an inert atmosphere, such as comprising argon. In particular embodiments, the inert atmosphere has a pressure between about 1 atmosphere (e.g., about 760 torr) and about 5 atmospheres (e.g., about 3800 torr), such as about 760 torr to about 1500 torr. As shown in FIG. 1, an inert gas can be introduced as a counter flow to regulate the reaction atmosphere, and to carry gaseous titanium chloride complexes and $AlCl_x$ away from the titanium alloy material, and any $TiCl_4$ produced during the reaction may be carried out of the reactor as a take-off by-product, which may be condensed and recycled for further reduction in stage 1. Thus, the reaction can be performed efficiently without any significant waste of Ti materials.

For example, the Ti is formed in a Ti—Al based alloy from the $Ti^{2+}$ in salt solution (condensed and vapor) by disproportionation and the formation of $Ti^{3+}$ in a salt solution (condensed and vapor), as described above ($Ti^{2+}=\frac{1}{3}[Ti]+\frac{2}{3}Ti^{3+}$). Similar corresponding disproportionation reactions are occurring simultaneously for $Al^{+}/Al/Al^{3+}$ and other alloying elements dissolved in the salt solutions and forming in the Ti—Al based alloys. Thus, pure-Ti products are not formed during these disproportionation reactions. Without wishing to be bound by any particular theory or specific reaction sequence, the Ti—Al alloy formation is believed to occur via an endothermic reaction which involves the input of heat to drive the reaction to towards the Ti—Al alloy products.

The Ti—Al alloy formed by the reactions above can be in the form of an Ti—Al alloy mixed with other metal materials. Alloying elements may also be included in the titanium chloro-aluminates consumed and formed in the disproportionation reactions above. Through control of the system, fine, uniformly alloyed particulates can be produced of the desired composition through control of at least temperature, heat flux, pressure, gas flowrate, $Al/AlCl_3$ ratio, and particle size/state of aggregation of the $Ti^{2+}/A/AlCl_3$ mixture entering the stage 2 reaction.

As a reaction product of the stage 2 reactions, a titanium alloy material is formed that includes elements from the reaction precursors and any additional alloying elements added during the stage 1 reaction and/or the stage 2 reactions. For example, Ti-6Al-4V (in weight percent), Ti-4822 intermetallic (48Al, 2Cr, and 2Nb in atomic percent) can be formed as the titanium alloy material. In one embodiment, the titanium alloy material is in the form of a titanium alloy powder, such as a titanium aluminide alloy powder (e.g., Ti-6Al-4V, Ti-4822, etc.).

Figure 3:
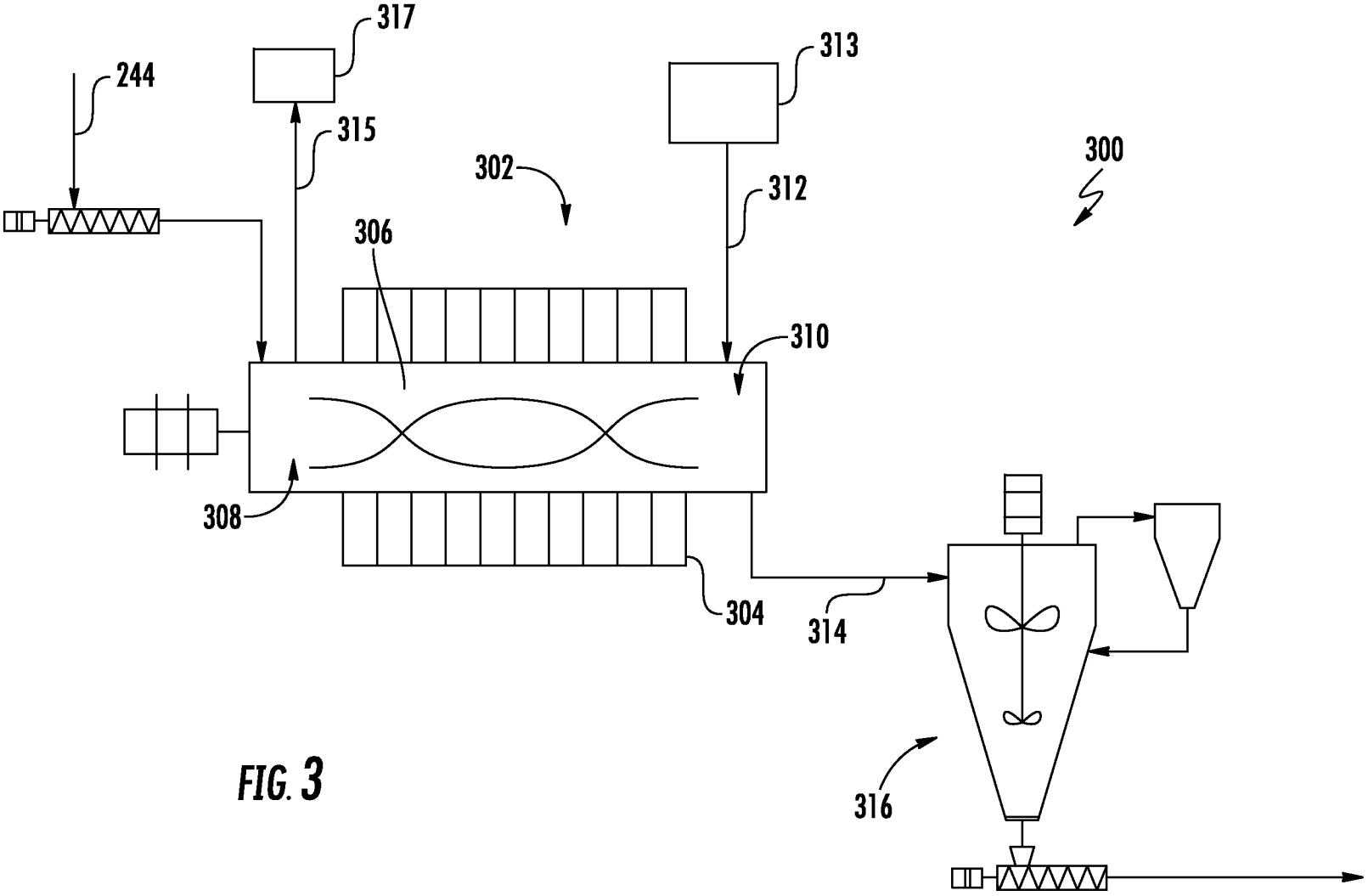
FIG. 3 shows a schematic of one exemplary embodiment of the stage 2 reaction and post-processing of the resulting titanium alloy material of the exemplary process of FIG. 1.

Referring to FIG. 3, a process schematic 300 of one exemplary embodiment of the stage 2 reaction at 106 and post processing at 108 of the exemplary process of FIG. 1. In the embodiment shown, the intermediate mixture is supplied via line 244 into a stage 2 reaction apparatus 302 after passing through an optional mixing apparatus 304. Within the stage 2 reaction apparatus 302, the $Ti^{2+}$ of the intermediate mixture is reduced to Ti alloy via a disproportionation reaction at a third reaction temperature, as described in greater detail above. The exemplary stage 2 reaction apparatus 302 shown is a single stage reactor that includes a zone heating apparatus 304 surrounding a reaction chamber 306. The zone heating apparatus 304 allows for a variable, increasing temperature within the reaction chamber 306 as the intermediate mixture flows through reaction chamber 306. For example, the zone heating apparatus 304 can have an increasing temperature from an input end of the reaction chamber 306 (e.g., a first zone 308) and a second reaction temperature at the output end of the reaction chamber 306 (e.g., a second zone 310). The apparatus may also have a gradation in reaction temperature between 2 or more zones. This process is designed to allow for uniform mixing and continuous flow through the temperature gradient.

Vapor reaction products, such as $AlCl_3$, $Al_2Cl_6$, $TiCl_4$, $TiAlCl_6$, AlOCl, $TiOCl(AlOCl)_x$, etc., can be removed from the reaction chamber 306 utilizing a counterflow gas stream of inert gas. For example, an inert gas can be supplied to the second zone 310 of the reaction chamber 306 via a supply tube 312 from an inert gas supply 313. The inert gas can then flow counter to the solid materials progressing through the reaction chamber 306 to carry gaseous titanium chloride complexes away from the titanium alloy material forming in the second zone 310. Additionally or alternatively, gaseous titanium chloride complexes and/or any $TiCl_4$ produced during the reaction may be carried out of the reaction chamber 306 as a take-off by-product through outlet line 315, which may be a heated line to prevent condensation and blockage, such as into a condenser 317 (e.g., a single-stage condenser or a multi-stage condenser) for recapture. Thus, the reaction can be performed efficiently without any significant waste of Ti materials.

The use of a low impurity inert gas (e.g., low impurity argon gas, such as a high purity argon gas) process gas is preferred to minimize the formation of oxychloride phases such as $TiOCl_x$ and $AlOCl_x$ in the process, and to ultimately inhibit the formation of TiO, $TiO_2$, $Al_2O_3$, and/or $TiO_2$—$Al_2O_3$ mixtures. Other inert gases can also be used, such as helium or other noble gases, which would be inert to the reaction process.

In-process monitoring can be used to determine reaction completion by measuring the balance, temperature, pressure, process gas chemistry, output product chemistry, and by-product chemistry.

The titanium alloy material can be collected via 314 to be provided into a post processing apparatus 316, such as described below. The post processing step may be performed in a separate apparatus or may be performed in the same or connected apparatus that is used for the Stage 2 process.

IV. Post Processing of Titanium Alloy

After formation, the titanium alloy material may be processed at 108. For example, the titanium alloy powder can be processed for coarsening, sintering, direct consolidation, additive manufacturing, bulk melting, or spheroidization. For example, the titanium alloy material may be high temperature processed to purify the Ti alloy by removing residual chlorides and/or allowing diffusion to reduce composition gradients, such as at a processing temperature of about 800° C. or higher (e.g., about 800° C. to about 1,000° C.).

In one embodiment, the high temperature processing also continues disproportionation reactions to produce Ti alloy from any residual $Ti^{2+}$.

EXAMPLES

Figure 4:
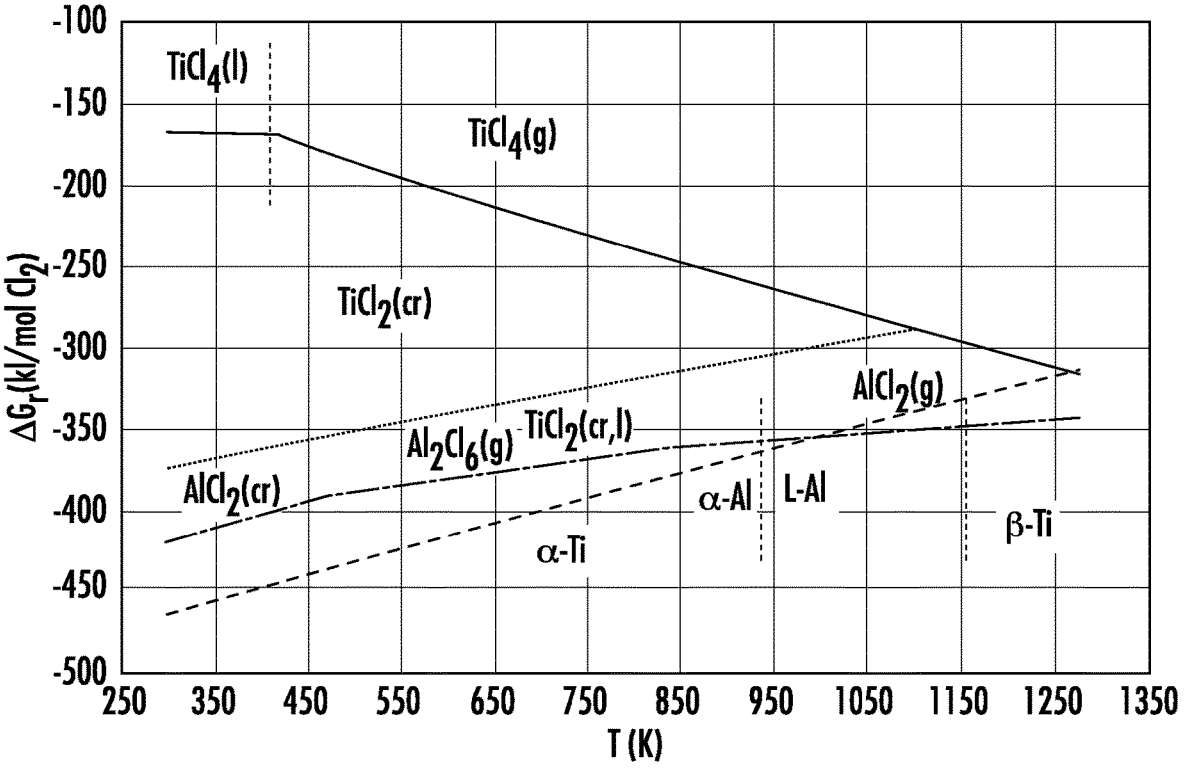
FIG. 4 shows an equilibrium stability diagram (Gibbs energy per mole of $Cl_2$ vs. absolute T) for Ti—Cl and Al—Cl systems overlaid to show reducing potential of metallic Al. Only pure elements (Ti, Al and $Cl_2$) and pure salt compounds ($TiCl_4$, $TiCl_3$, $TiCl_2$ and $AlCl_3$) are considered because there is no assessed thermodynamic data for salt solution phases ($TiCl_4(AlCl_3)_x$, $TiCl_3(AlCl_3)_x$, $TiCl_2(AlCl_3)_x$).

The process described here can be explained in the most general and simplest terms by inspecting the overlaid stability diagrams (Gibbs energy per mole of $Cl_2$ vs. absolute T) for the Ti—Cl and Al—Cl systems, shown in FIG. 4.

While alloy or salt solutions are not considered, it shows the maximum available chemical energy in the Ti—Al—Cl system. At temperatures below 1000K (730° C.) $Ti^{4+}$, as $TiCl_4$ (l,g), can be reduced to $Ti^{3+}$, as $TiCl_3$(s), and subsequently to $Ti^{2+}$, as $TiCl_2$(s), by the oxidation of Al metal to $Al^{3+}$ (in the form of $AlCl_3$(s), $Al_2Cl_6$(g) and/or $AlCl_3$(g)), but $Ti^{2+}$ cannot be reduced to metallic Ti by oxidation of metallic Al. In this process metallic titanium alloyed with Al, [Ti], can form in the temperature range 523 to 923K (250° C. to 650° C.) via disproportionation of $Ti^{2+}$ ($Ti^{2+}=\frac{1}{3}[Ti]+\frac{2}{3}Ti^{3+}$) in a salt solution [$Ti^{2+}$:salt] producing [Ti] particles and $Ti^{3+}$ as a salt solution [$Ti^{3+}$:salt] or vapour. Al driven reduction of $Ti^{4+}$ and $Ti^{3+}$ is an exothermic process and is carried out in the stage one, S1, reactor and low temperature part of stage two, S2, reactor at temperatures below 523K (250° C.), while $Ti^{2+}$ disproportionation is an endothermic process and is carried out at an intermediate temperature range in the S2 reactor.

An absence composition gradients within particles is typical for alloy product of the process (operating under optimized conditions), as shown in FIG. 2. The temperature range in which alloy particles form, 523 to 923K (250 to 650° C.), and time taken to form, less than 10 min, mean the observed intra-particle homogeneity cannot be due to diffusion within the alloy, because the rate is too slow. Rather metallic Al and other alloying elements, M, are precipitating from the salt simultaneously with $Ti^{2+}$ and via corresponding disproportionation reactions (i.e., for Al: $Al^{+}=\frac{2}{3}[Al]+\frac{1}{3}Al^{3+}$ and for M: $M^{x+}=1/(x+1)[M]+x/(x+1)M^{(x+1)+}$) and the supply of low oxidation state ions from the salt to the growth front of alloy particles is not hindered.

Example 1

(Stage 1 process to $Ti^{2+}$ (after forming $Ti^{3+}$), with the option of producing $TiAlCl_5$(s), T<187° C. or $\{Ti(AlCl_4)_2\}_n$, 187° C.<T<230° C., salt solution phases confirmed).

A chemical reduction reaction of $Ti^{4+}$, initially in the form of $TiCl_4(l)$ to $Ti^{3+}$, as $TiCl_3(AlCl_3)_x$, was performed in the stage 1 reactor and evaluated in an inert environments. The input mixture includes 201.8 g Al flake, 100.5 g $AlCl_3$, 34.3 g $NbCl_5$, and 20.1 g of $CrCl_3$ that was loaded under a high purity argon atmosphere into a sealed ball milled and milled for 16 hours at close to room temperature (multiple ball mills provide feed for each stage 1 run). The milled material was sieved at 150 μm sieve size and 594.1 grams, nominally from two mills, were loaded into a plow mixer reactor, under a high purity argon atmosphere. The reactor is maintained at a pressure of 1.2 barg with a low flow (less than 1 l/min) of high purity argon flowing through the reactor. The reactor and charge was preheated to 130° C. and stabilized before 1164 g of $TiCl_4(l)$ was injected at a rate of 6.5±2.0 g/min while continuously mixing. During the time $TiCl_4(l)$ is injected it initially evaporates, but overtime $TiCl_4(l)$ forms as the reactor wall is maintained at about 130° C., while the bulk free flowing in process charge, {salt+Al}, can reach temperatures up to 145° C. Following addition of all $TiCl_4(l)$ reactor wall temperature is maintained 130° C. for nominally the same time taken for $TiCl_4$ injection, during which the condensed $TiCl_4(l)$, absorbed in the input mixture and reaction product salt, continues to reaction and is reduced. After the majority of condensed $TiCl_4(l)$ is reduced (indicated by a drop in bulk change temperature and gas temperature above the mixed charge) the reactor wall temperature was increased to 160° C. and held. This ensures all the condensed $TiCl_4(l)$ at the reactor wall is able to reduced or can be removed. This intermediate material can be cooled and removed from the reactor (as $TiCl_3(AlCl_3)_x$) or it can be heated to about 185° C. where $Ti^{3+}$ is reduced to $Ti^{2+}$ as $TiAlCl_5(s)$ or heated to about 200° C. to about 230° C. to convert $TiAlCl_5(s)$ to $\{Ti(AlCl_4)_2\}_n$.

Cooling the S1 reactor to room temperature and taking representative product samples from the process described above can be characterized, provided suitable precautions are taken to stop reaction with air, using XRD, ICP, Cl titration and electron microscopy and EDS analysis to evaluate form of the metal chlorides. The results of this characterization confirm the product includes residual unreacted Al particles with consistent shape and size observed in the milled product loaded into the plough reaction and also the amount consistent with reduction of $TiCl_4$ added. The microstructure observed with SEM show the Al particles are surrounded by a graded layer of product salt, the salt in contact the Al surface is $AlCl_3$-rich and it is common to observe segregation of O at this interface as an oxy-chloride layer "AlOCl". Further form the surface of the Al particle the $TiCl_3(AlCl_3)_x$ phase exists and represents the bulk of the product of this reaction. This salt product has poor mechanical properties and easily separates the core Al particle and can exist isolated from Al particles. XRD analysis shows the $TiCl_3(AlCl_3)_x$ salt phase typically exists as has a the α phase, hexagonal close packed structure and is consistent with published literature. This crystal structure is consistent with $AlCl_3(TiCl_3)_x$ and there is evidence of a continuous solid solution. The measured composition of the bulk sample composition with consistent with XRD and the observed microstructure.

If the $Ti^{3+}$ salt $TiCl_3(AlCl_3)_x$+Al-flake mixture is further heated in the S1 reactor (after cooling to room temperature, removing from the S1 reactor for characterization and returning to the S1 reactor or not removing and continuing to heat from 160° C.) it can be reduced to $Ti^{2+}$ by the oxidation the stoichiometric amount of Al flake. This process involves either: heating from room temperature to 150° C. and holding for 1 hr if the $TiCl_3(AlCl_3)_x$+Al-flake mixture was removed from the S1 reactor in ramping at about 1 deg/min to 185° C. or heating from 160° C. at 1 deg/min to 185° C. if the $TiCl_3(AlCl_3)_x$+Al-flake mixture was not removed from the reactor. Just prior to heating from 150° C. or 160° C. the pressure in the reactor is increased from 1.2 bar to at least 1.9 bar to suppress the rate of $Al_2Cl_6(g)$ generation above 185° C. The $Ti^{3+}$ in $TiCl_3(AlCl_3)_x$ starts reducing to $Ti^{2+}$ during heating, but holding the reactor at about 185° C. for 1 hr is sufficient to fully convert all $Ti^{3+}$. After cooling to room temperature representative samples can be taken and characterized by chemical analysis, SEM and XRD. The microstructure observed by SEM show that the sample contains unreacted Al flake surrounded by an $AlCl_3$-rich salt like that in the $TiCl_3(AlCl_3)_x$+Al-flake mixture only heated to 160° C., but in this case $AlCl_3$-rich salt layer is thicker and a different morphology, presumably due to local melting of the salt but this was not directly observed. XRD analysis of the sample shows that metallic Al exits, while the characteristic peaks of the $TiCl_3(AlCl_3)_x$ salt solution have disappeared and are replaced with characteristic peaks of a crystalline form of $\{Ti(AlCl_4)_2\}_n$ or $TiAlCl_5(s)$.

If this material is heated to about 220° C. to about 230° C. the all the crystalline salt phase coverts to an amorphous phase. This is observed in the XRD spectrum as an absence of peaks apart from those of metallic Al. The microstructure of this material, observed with SEM, again show an $AlCl_3$-rich salt surrounding the Al-flake and a more homogenous bulk salt phase.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed:

1. A process for producing a titanium alloy material, comprising:

adding $TiCl_4$ to an input mixture at a first reaction temperature such that at least a portion of the $Ti^{4+}$ in the $TiCl_4$ is reduced to a first intermediate reaction mixture, wherein the input mixture comprises aluminum, optionally $AlCl_3$, and, optionally, one or more alloying element chloride, and wherein the first intermediate reaction mixture comprises an $AlCl_3$-based salt solution that includes $Ti^{3+}$;

thereafter, drying the first intermediate reaction mixture at a drying temperature of about 160° C. to about 175° C.;

thereafter, heating to a second reaction temperature such that at least a portion of the $Ti^{3+}$ of the first intermediate reaction mixture is reduced to a second intermediate reaction mixture, wherein the second intermediate reaction mixture is an $AlCl_3$-based salt solution that includes $Ti^{2+}$, wherein adding $TiCl_4$ to the input mixture at the first reaction temperature and heating to the second reaction temperature are performed sequentially in a reaction process; and further heating the second intermediate reaction mixture to a third reaction temperature such that the $Ti^{2+}$ forms the titanium alloy material via a disproportionation reaction.

2. The process of claim 1, wherein the input mixture comprises a plurality of particles, and wherein the plurality of particles comprise aluminum, $AlCl_3$, and, optionally, one or more alloying element chloride, and further wherein the plurality of particles of the input mixture have a minimum particle dimension on average of about 0.5 μm to about 25 μm.

3. The process of claim 2, wherein the one or more alloying element chloride is present in the input mixture, and wherein the at least one alloy chloride is selected from the group consisting of $VCl_3$, $CrCl_2$, $CrCl_3$, $NbCl_5$, $FeCl_2$, $FeCl_3$, $YCl_3$, $BCl_3$, $MnCl_2$, $MoCl_3$, $MoCl_5$, $SnCl_2$, $ZrCl_4$, $NiCl_2$, CuCl, $CuCl_2$, $WCl_4$, $WCl_6$, $BeCl_2$, $ZnCl_2$, LiCl, $MgCl_2$, $ScCl_3$, $PbCl_2$, $Ga_2Cl_4$, $GaCl_3$, $ErCl_3$, $CeCl_3$, and mixtures thereof.

4. The process of claim 1, wherein the input mixture comprises reaction mixture to form Ti-6Al-4V by weight percent.

5. The process of claim 1, wherein the input mixture comprises reaction mixture to form Ti-48Al-2Cr-2Nb by atomic percent.

6. The process of claim 1, wherein the first reaction temperature is about 100° C. to about 165° C.

7. The process of claim 1, wherein the aluminum present in the input mixture reduces the $Ti^{4+}$ in the $TiCl_4$ to $Ti^{3+}$.

8. The process of claim 1, wherein the $TiCl_4$ is added as a liquid or vapor mixed with the one or more alloying element chloride.

9. The process of claim 1, wherein reducing the $Ti^{4+}$ in the $TiCl_4$ to form $Ti^{4+}$ is performed in a plow reactor, a ribbon blender, or another liquid/solid/vapor reactor.

10. The process of claim 1, wherein adding the $TiCl_4$ to the input mixture is performed in an inert atmosphere having a pressure of about 700 torr to about 3800 torr.

11. The process of claim 1, wherein the $Ti^{3+}$ in the first intermediate reaction mixture is in the form of $TiCl_3$ complexed with at least one metal chloride.

12. The process of claim 1, wherein the $Ti^{3+}$ in the first intermediate reaction mixture is in the form of $TiCl_3(AlCl_3)_x$ with x being greater than 0 to 10.

13. The process of claim 1, wherein adding $TiCl_4$ to an input mixture at a first reaction temperature and heating to a second reaction temperature are performed in a single step reaction.

14. The process of claim 1, wherein adding $TiCl_4$ to an input mixture at a first reaction temperature and heating to a second reaction temperature are performed in separate steps as a two-step reaction process.

15. The process of claim 1, wherein heating the first intermediate reaction mixture to a second reaction temperature is performed in an inert atmosphere, and wherein the inert atmosphere has a pressure of about 700 torr to about 3800 torr.

16. The process of claim 1, wherein at least a portion of the $Ti^{2+}$ in the second intermediate reaction mixture is in the form of $TiCl_2$ complexed with metal chloride(s).

17. The process of claim 1, wherein substantially all of the $Ti^{2+}$ in the second intermediate reaction mixture is in the form of $TiCl_2$ complexed with the one or more alloying element chloride(s), and wherein substantially all of the $TiCl_4$ is reacted or distilled from the first intermediate reaction mixture prior to $Ti^{3+}$ reduction to $Ti^{2+}$.

18. The process of claim 1, reacting the to the $Ti^{2+}$ titanium alloy material via a disproportionation reaction is performed in a multi-zone reaction chamber.

19. The process of claim 1, further comprising:

flowing an inert gas through a multi-zone reaction chamber, wherein the inert gas flow is counter to the progression of the first intermediate reaction mixture and the second intermediate reaction mixture, and wherein the inert gas is introduced as a counter flow to carry gaseous titanium chloride complexes away from the titanium alloy material formed and back into the reaction zone for either or both reactions of $Ti^{3+}$ to $Ti^{2+}$ and/or $Ti^{2+}$ to Ti alloy.

20. The process of claim 1, wherein reacting the $Ti^{2+}$ via a disproportionation reaction to form the titanium alloy material is performed at an inert atmosphere has a pressure of about 700 torr to about 3800 torr.

21. The process of claim 1, wherein any $Ti^{3+}$ formed during the disproportionation reaction is internally recycled to be reduced to $Ti^{2+}$ and further reacted in a disproportionation reaction.

22. The process of claim 1, wherein the titanium alloy material is a titanium alloy powder.

23. The process of claim 1, further comprising:

high temperature processing the titanium alloy material at a processing temperature to purify the Ti alloy by removing residual chlorides and/or allowing diffusion to reduce composition gradients.

24. The process of claim 23, wherein the high temperature processing also continues disproportionation reactions to produce Ti alloy from any residual $Ti^{2+}$.

25. The process of claim 23, wherein the processing temperature is about 800° C. or higher.

26. The process of claim 1, further comprising:

adding alloying element halides into input mixture, during the reaction forming the first intermediate reaction mixture, during the reaction forming the second intermediate reaction mixture, during the disproportionation reaction, or during post processing.

27. A process for producing a titanium alloy material, comprising:

adding $TiCl_4$ to an input mixture at a first reaction temperature such that at least a portion of the $Ti^{4+}$ in the $TiCl_4$ is reduced to a first intermediate reaction mixture, wherein the input mixture comprises aluminum, optionally $AlCl_3$, and, optionally, one or more alloying element chloride, and wherein the first intermediate reaction mixture comprises an $AlCl_3$-based salt solution that includes $Ti^{3+}$;

heating to a second reaction temperature such that at least a portion of the $Ti^{3+}$ of the first intermediate reaction mixture is reduced to a second intermediate reaction mixture, wherein the second intermediate reaction mixture is an $AlCl_3$-based salt solution that includes $Ti^{2+}$, wherein adding $TiCl_4$ to the input mixture at the first reaction temperature and heating to the second reaction temperature are performed sequentially in a reaction process; and further heating the second intermediate reaction mixture to a third reaction temperature such that the $Ti^{2+}$ forms the titanium alloy material via a disproportionation reaction, wherein the third reaction temperature is about 250° C. to about 650° C.

28. A process for producing a titanium-containing material, comprising:

mixing Al particles, $AlCl_3$ particles, and, optionally, particles of at least one other alloy chloride to form an input mixture;

adding $TiCl_4$ to the input mixture;

reducing $Ti^{4+}$ in the $TiCl_4$ in the presence of the input mixture at a first reaction temperature to form a first intermediate reaction mixture comprising $Ti^{3+}$, wherein the first reaction temperature is lower than about 150° C.;

thereafter, drying the first intermediate reaction mixture at a drying temperature of about 160° C. to about 175° C.; and thereafter, reducing the first intermediate reaction mixture comprising $Ti^{3+}$ in the presence of the input mixture at a second reaction temperature to form a second intermediate reaction mixture comprising $Ti^{2+}$, wherein the second reaction temperature is about 160° C. to about 250° C.

29. The process of claim 28, further comprising:

isolating $Ti^{2+}$ species from the second intermediate reaction mixture, wherein the $Ti^{2+}$ of the second intermediate reaction mixture is in the form of $TiCl_2$ complexed with metal chloride(s).

30. The process of 29, further comprising:

thereafter, reacting the second reaction intermediate comprising $Ti^{2+}$ via a disproportionation reaction in the presence of the input mixture to form the titanium alloy material.

31. A process for producing a titanium alloy material, comprising:

adding $TiCl_4$ to an input mixture at a first reaction temperature such that at least a portion of the $Ti^{4+}$ in the $TiCl_4$ is reduced to a first intermediate reaction mixture, wherein the input mixture comprises aluminum, optionally $AlCl_3$, and, optionally, one or more alloying element chloride, and wherein the first intermediate reaction mixture comprises an $AlCl_3$-based salt solution that includes $Ti^{3+}$; and heating to a second reaction temperature such that at least a portion of the $Ti^{3+}$ of the first intermediate reaction mixture is reduced to a second intermediate reaction mixture, wherein the second intermediate reaction mixture is an $AlCl_3$-based salt solution that includes $Ti^{2+}$, wherein adding $TiCl_4$ to the input mixture at the first reaction temperature and heating to the second reaction temperature are performed sequentially in a reaction process; and thereafter, reacting the second reaction intermediate comprising $Ti^{2+}$ via a disproportionation reaction at a third reaction temperature in the presence of the input mixture to form the titanium alloy material, wherein the third reaction temperature is about 250° C. to about 650° C.

32. The process of claim 31, further comprising:

isolating $Ti^{2+}$ species from the second intermediate reaction mixture, wherein the $Ti^{2+}$ of the second intermediate reaction mixture is in the form of $TiCl_2$ complexed with metal chloride(s).

* * * * *